United States Patent [19]

Barstow

[11] Patent Number: 4,487,120

[45] Date of Patent: Dec. 11, 1984

[54] METHOD AND APPARATUS FOR PROCESSING BRUSH CUTTINGS

[76] Inventor: James H. Barstow, 1281 N. Pepper St., Turlock, Calif. 95380

[21] Appl. No.: 485,235

[22] Filed: Apr. 15, 1983

[51] Int. Cl.[3] ..... B30B 9/00

[52] U.S. Cl. ..... 100/40; 100/42; 100/77; 100/100; 100/215; 100/218; 100/232; 100/295; 212/180; 414/345; 414/525 R; 414/786

[58] Field of Search ..... 100/35, 40, 41, 94, 100/98 R, 100, 215, 251, 232, 42, 218, 76, 77, 295; 414/345, 347, 525 R, 786; 212/180; 56/52, DIG. 2

[56] References Cited

U.S. PATENT DOCUMENTS

| | | | |
|---|---|---|---|
| 9,617 | 3/1853 | Bessemer | 100/98 R |
| 251,768 | 1/1882 | Dederick | 100/41 |
| 2,932,244 | 4/1960 | Moyer | 100/100 X |
| 3,059,789 | 10/1962 | Bowles | 100/100 X |
| 3,583,164 | 6/1971 | Sherrill | 100/100 X |
| 3,880,072 | 4/1975 | Ord | 100/100 |

*Primary Examiner*—Billy J. Wilhite

*Attorney, Agent, or Firm*—Limbach, Limbach & Sutton

[57] ABSTRACT

A method and apparatus for processing elongate brush cuttings, such as those resulting from the pruning of almond trees. The method comprises collecting the cuttings, loading them into the compaction chamber of a packer, moving a plunger longitudinally through the chamber to compress the cuttings and force them into an orientation extending generally normal to the direction of plunger travel, and discharging the cuttings from one end of the chamber while maintaining said orientation. The apparatus comprises a wheel supported chassis which carries a transfer packer and a crane supported grapple for loading cuttings into the packer. The packer has an open topped hopper into which the cuttings are charged. The plunger moves through the hopper to compress cuttings received therein and force said cuttings through a discharge opening in one side of the hopper.

12 Claims, 8 Drawing Figures

METHOD AND APPARATUS FOR PROCESSING BRUSH CUTTINGS

BACKGROUND OF THE INVENTION

The present invention relates to the art of processing brush cuttings, such as those resulting from the pruning of almond trees, and more particularly is concerned with the formation of bales of such cuttings which are storable in stacked condition and ideally suited for use as combustible fuel. In its more specific aspects, the invention is directed to a method for forming and transporting such bales and an apparatus which may be employed to practice the method.

Prior efforts relating to the baling of prunings have employed compactors which compress with either a single vertically moving plunger, or a multiplicity of lateral plungers. The latter type are similar in operation to those used in wrecking yards. Both techniques have required that the loose cuttings be transported to a central compacting area, and result in a bale which is extremely dense, with the cuttings positioned in large part, horizontally. The resulting bales captured dirt and water and, due to the presence of water, posed a risk of spontaneous combustion. The presence of the dirt and water also made them less than ideal for use as combustible fuel. Furthermore, the extremely dense and interwoven character of the bales made it very difficult to separate them into combustible sized components. Such separation required the use of saws or large-scale shearing mechanisms.

Although transfer packers and transfer trailers similar to those employed in the present invention are known in the refuse processing art, they have not been used for the processing of elongate brush cuttings, nor have they been provided in a fully portable configuration wherein the packer is provided with a crane-operated grapple for loading cuttings directly into the packer. Refuse systems generally employ relatively small collection vehicles (garbage trucks) which collect refuse and take it to a stationary central processing station where it is compacted within a packer and then discharged into a transfer trailer for transport to a dump site. Refuse systems have not been concerned with the formation of bales of relatively dry and clean material which may be readily separated for use as combustible fuel.

SUMMARY OF THE INVENTION

In the method of the invention, successive charges of elongate brush cuttings are loaded into a chamber having a compaction plunger movable therethrough in a longitudinal direction. The cuttings are loaded so as to extend in a direction parallel to the longitudinal direction of plunger movement. Each charge is compressed and discharged by moving the plunger through the chamber to force the cuttings into a vertical orientation extending generally normal to the direction of plunger travel. The successive charges of brush so compressed are collected in juxtaposition, while maintaining the cuttings therein in a vertical orientation.

The transfer packer apparatus of the invention is supported on a wheel supported chassis and comprises an open topped hopper and a compaction ram having a plunger movable longitudinally through the hopper. A deck is supported on the chassis above the compaction ram. The deck carries a pivotal crane having an articulated lifting arm with a grapple at the distal end thereof. The arm is selectively operable to move the grapple from pickup positions to the sides of the packer to a discharge position within the open top of the hopper. A coupling is carried by the chassis to secure a transfer trailer in receiving relationship to the discharge opening of the hopper.

A principal object of the invention is to provide a method and apparatus for compacting elongate brush cuttings into bales storable in stacked relationship and readily separable to provide a clean and dry combustible fuel.

Another object of the invention is to provide such a method and apparatus wherein the cuttings within the bales assume a vertical orientation which facilitates the gravity separation of dirt therefrom and the evaporation of moisture.

Another object of the invention is to provide such a method and apparatus which may be used in the field where the cuttings are harvested and does not require that the cuttings be transported to a central station for the bale formation process.

Another object related to the latter object is to provide such an apparatus which is capable of picking up cuttings disposed to the sides of the apparatus.

Another object of the invention is to provide such an apparatus which accumulates the cuttings under pressure and in a condition for ready transport to any desired storage location.

A further object of the invention is to provide such a method and apparatus which may handle high volumes of cuttings, with a minimum of operating personnel and a minimum number of handling and transport steps.

Another and more specific object of the invention is to provide a method and apparatus for forming such bales wherein segments of the bales may be separated for use as a combustible fuel by simply peeling off wafer-like sections, without the necessity of employing saws or heavy cutting equipment.

Another object of the invention is to provide such a method and apparatus wherein the resulting bales may be readily handled and separated by conventional equipment, such as a standard "hay squeeze".

Yet another object of the invention is to provide such an apparatus which is portable and may be wheel supported for transport to the harvest field.

The foregoing and other objects will become more apparent when viewed in light of the following detailed description and accompanying drawings.

DESCRIPTION OF THE PREFERRED EMBODIMENT

Although the invention will be described herein primarily with reference to the processing of almond tree cuttings, it may be used to bale other varieties of elongate cuttings, such as those which result from the pruning of peach, apricot or walnut trees, or the pruning of vines.

Figure 1:
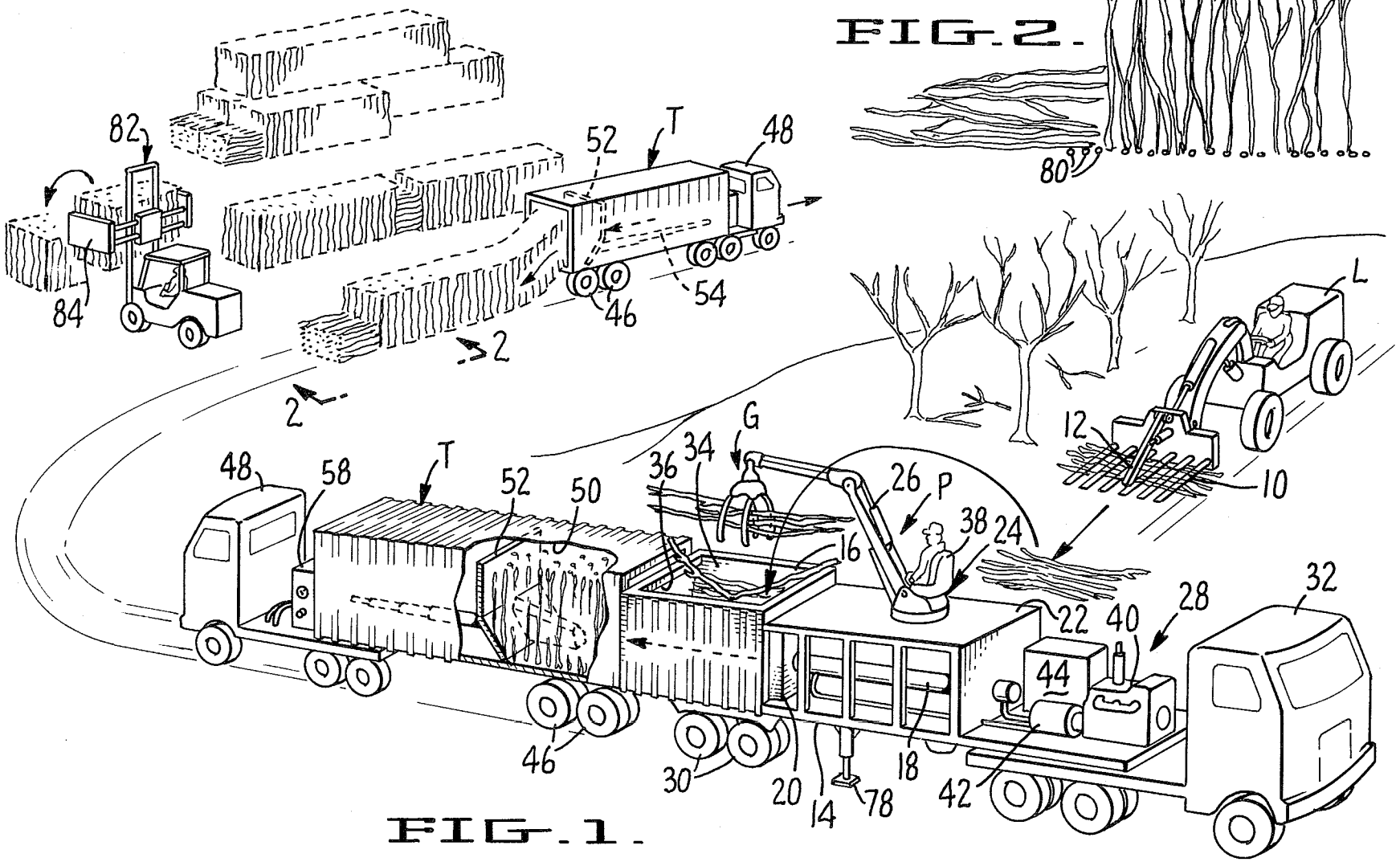
FIG. 1 is a perspective view diagrammatically illustrating the method and apparatus in use in an almond orchard, and the transport and storage of the resulting bales.

Referring to FIG. 1, a freshly pruned almond tree orchard "O" is shown therein in the process of having pruning cuttings collected and processed through means of the present invention. A rake-type loader "L" is shown picking up cuttings from the orchard. The loader includes power operated fork 10 having an hydraulically operated hold-down arm 12. In use, the fork is engaged beneath the cuttings being collected and, once so engaged, the arm 12 is lowered to hold the cuttings in place as the loader is used to transfer the cuttings to the baling site.

The packer is designated in its entirety by the letter "P". Its principal components comprise: a wheel supported chassis 14; a hopper 16 supported on one end of the chassis; a compaction ram 18 supported on the chassis to one side of the hopper 16, said ram carrying a plunger 20 for select movement longitudinally through the compaction chamber of the hopper; a deck 22 supported on the chassis above the ram 18; a power operated crane 24 supported on the deck for movement about a generally vertical axis, said crane having an articulated lifting arm 26 carrying grapple "G" at the distal end thereof; and an hydraulic power supply 28 for the ram and crane.

The chassis 14 is of the semi-trailer type and supported at its rearward end by wheels 20 and at its forward end by a semi-trailer type tractor 32. A fifth wheel connection 33 (see FIG. 3) connects the chassis to the tractor.

The hopper, ram and plunger may be of the same type used in stationary refuse processing plants, for example a Heil Model HTP-1000 Transfer Packer (manufactured by The Heil Co., Milwaukee, Wisconsin). The hopper provides a compaction chamber 34 which terminates in open discharge end 36 at the rear end of the chassis 14. The plunger 20 is movable through the chamber through operation of the ram 18 to first compact material within the compaction chamber, and then discharge the material through the opening 36.

The crane 24 is designed to be controlled by a human operator and is provided with a seat 38 for the support of the operator. The crane controls are located in front of the seat. The mechanism of the crane is similar to that of a backhoe, with the addition that it includes means to pivot the crane about the vertical axis and means to operate the grapple. The arm 26 is so proportioned that it may be used to move the grapple to pickup positions to the sides of the packer and a discharge position within the hopper. The grapple is hydraulically operated and controlled by the crane operator through the crane controls.

The power supply unit 28 is of conventional construction. It comprises an engine 40, hydraulic pump 42 and oil reservoir 44. Lines and valves connect the pump to the ram 18 and crane 24. Both the crane and ram are remotely operable by the crane operator.

Figure 3:
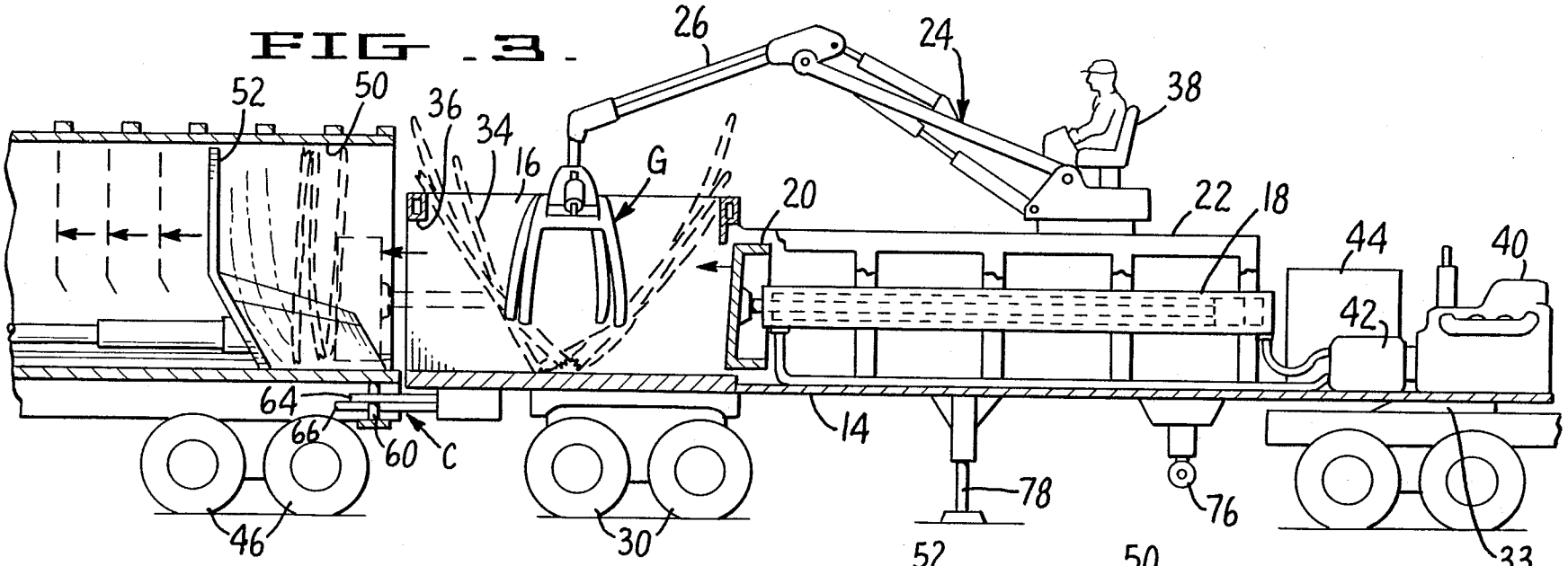
FIG. 3 is a side elevational view, with parts thereof shown in section, illustrating the transfer packer of the invention in the process of being loaded, with a transfer trailer coupled to the packer.

As shown in FIGS. 1 and 3, the packer is coupled to a transfer trailer "T" through means of a coupling "C". The trailer "T" is of conventional construction and may take the form of a Heil HT-65 or HT-75 transfer trailer. It is of semi-trailer configuration, supported at its rearward end by wheels 46 and at its forward end by a semi-trailer tractor 48. The trailer provides a transfer chamber 50 having an open rearward end for receipt of material discharged through the opening 36 of the hopper 16. A biased wall 52 is slidably received within the chamber 50 for movement in response to force imparted thereto by material discharged into the trailer through means of the force of the plunger 20. A telescopic hydraulic ram 54 within the trailer "T" serves to bias the wall 52 during loading of the trailer and, upon full loading of the trailer, may be extended to discharge a load therefrom. An hydraulic power supply 58 and control therefor is provided at the forward end of the trailer.

Figure 6:
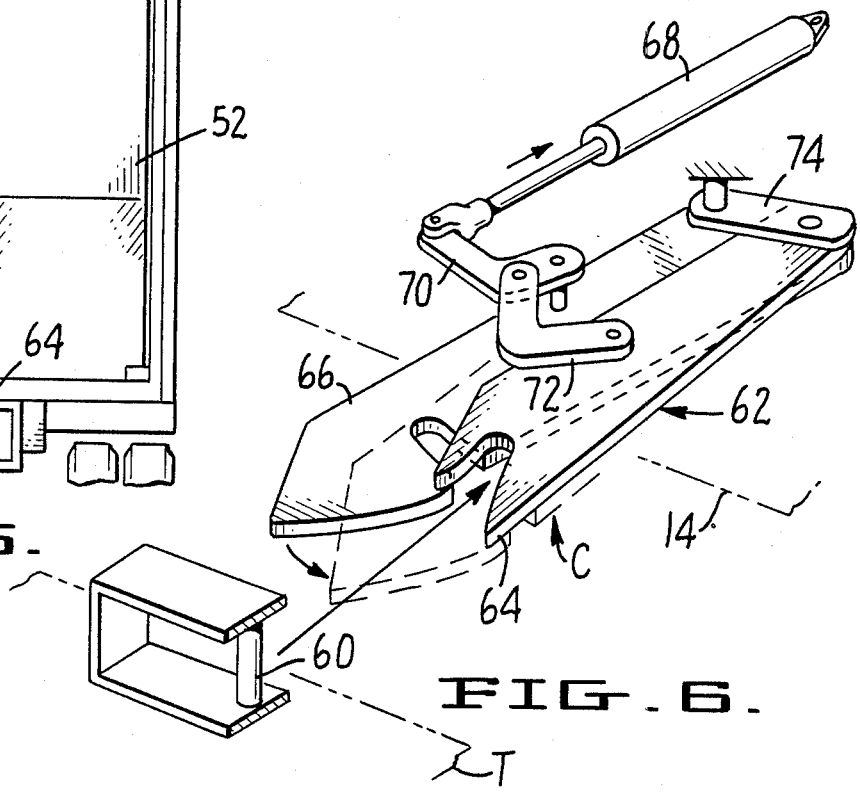
FIG. 6 is a perspective view of the coupling used to couple the transfer packer to the transfer trailer, with solid lines showing the coupling in the open condition and phantom lines showing the coupling in the closed condition.

The coupling "C" is shown in FIG. 6 and comprises a pintle 60 mounted on the trailer "T" and a pintle hook mechanism 62 mounted on the chassis 14 of the packer "P". The mechanism 62 includes a fork 64 engageable around the rear and lateral sides of the pintle 60 and a hook 66 pivotal relative to the fork 64 between the open and closed conditions shown in solid and phantom line representation, respectively, in FIG. 6. An hydraulic actuating cylinder 68 is provided to move the hook 66 between the open and closed conditions through means of a first L-shaped link 70 pivotally connected between the piston rod of the cylinder and the top of the hook 66, and a second L-shaped link 72 pivotally connected between the first link and the top of the fork 64. The proximal ends of the fork 64 and hook 66 are pivotally interconnected by a straight link 74. To effect coupling, the trailer and packer are moved together to force the pintle 60 into the bifurcation of the fork 64 and the cylinder 68 is then actuated to swing the hook 66 to the closed condition, thereby capturing the pintle within the fork. To release the coupling, the cylinder 68 is actuated to move the hook to the open condition.

As may best be seen from FIG. 3, the packer "P" is provided with two retractable ground supports. The first of these supports comprises a pair of retractable wheels 76 designed to support the chassis of the packer when it is disconnected from a semi-trailer tractor. The second comprise a pair of jack stands 78 designed to stabilize the packer when it is in the process of being used for compaction.

In operation, elongate cuttings are first collected on the ground to the side of the packer "P". The loader "L" is used for purposes of such collection. Although FIG. 1 illustrates cuttings to only one side of the packer, it should be understood that cuttings may be collected at various locations around the packer and that the crane 24 is adapted to pick up cuttings from either side of the packer.

Once sufficient cuttings are collected, the crane operator operates the crane and grapple to pick the cuttings up and load them into the compaction chamber 34 through the open top of the hopper 16. Such loading is carried out so that the cuttings extend generally parallel to the direction of longitudinal movement of the plunger 20. In the event that the cuttings are of a length greater than the length of the hopper 16, the grapple is forced into the hopper so as to fold the cuttings about axes extending generally normal to the direction of plunger travel. Such folding may be seen from FIG. 3.

Upon loading of the compaction chamber to the desired degree, the ram 18 is actuated to move the plunger 20 longitudinally through the compaction chamber, thus compacting the cuttings within the chamber and forcing them into a vertical orientation extending generally normal to the direction of plunger travel. During such compaction, the plunger forces the cuttings through the opening 36 and against the biased wall 52. The ram 54 retracts responsive to the pressure imparted thereto by the plunger 20 through the cuttings captured between the wall 52 and the plunger.

The steps of loading the compaction chamber 34, compacting a charge of cuttings therein, and discharging the cuttings into the transfer trailer are successively repeated until the wall 52 is fully retracted within the trailer and the trailer is full of compacted cuttings. Such successive steps are diagrammatically illustrated by the phantom lines and arrows seen in the trailer illustrated in FIG. 3.

In the preferred mode of operation, cuttings having a length greater than the hopper are first brought to the packer by the grapple so as to assume a longitudinal position bridging the open top of the hopper. The grapple is then lowered to press the cuttings toward the floor of the compaction chamber, thus causing the cuttings to bend or fold in the middle. The grapple is then released from the cuttings and lifted above the hopper. Then, after crossing the tines of the grapple, the grapple is again lowered into the compaction chamber to hold the cuttings in place as the packer ram is activated to compress the cuttings and move them toward the transfer trailer. The latter action causes the cuttings to be folded into a V-shaped configuration with the legs of the V extending vertically. The grapple is then withdrawn and the V-shaped cuttings are then finally pressed flat into the transfer trailer, as seen to the left of FIG. 3.

Figure 2:
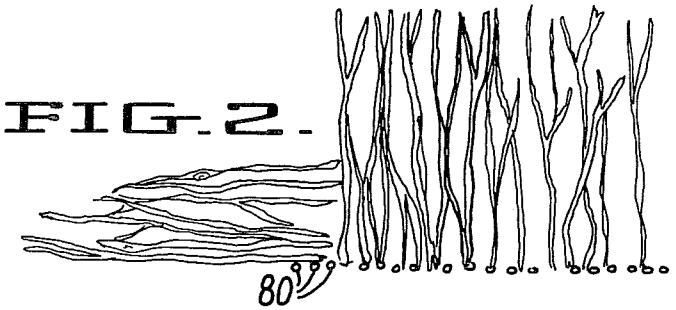
FIG. 2 is a cross-sectional view taken on the plane designated by line 2—2 of FIG. 1.
Figure 4:
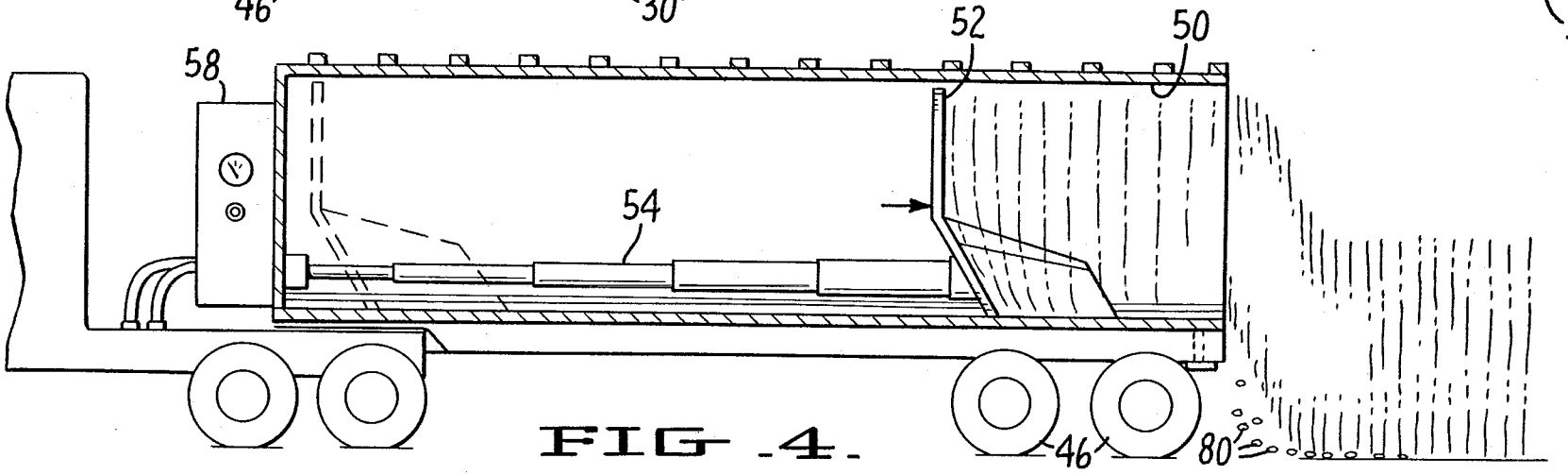
FIG. 4 is a side elevational view of the transfer trailer, in the process of unloading a bale.
Figure 5:
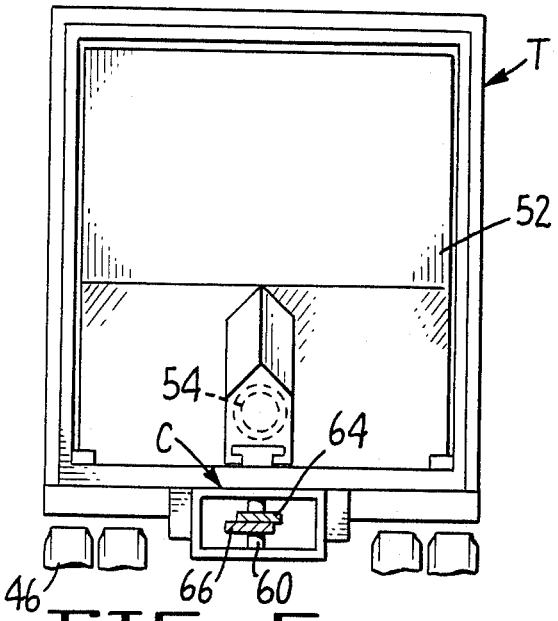
FIG. 5 is a rear end elevational view of the transfer trailer.

Once the trailer is full of compacted cuttings, the trailer and packer are uncoupled and the trailer is then driven to a discharge site, as seen to the left of FIG. 1. At the discharge site, the ram 54 within the trailer is actuated to discharge the bale of cuttings formed within the trailer. The trailer is shown in the process of discharging to the left of FIG. 1. FIG. 4 also shows a trailer in the process of discharging bale, From these figures, it will be seen that the cuttings within the bale being discharged from the trailer remain in a vertical orientation so that dirt particles may fall therefrom during the discharging operation. Such particles are illustrated in FIG. 4 and designated by the numeral 80. From FIGS. 1 and 2, it will also be seen that the endmost section of the bale discharged from the trailer may fall to a horizontal position, thus forming a stop for the remainder of the bale, in "bookend" fashion.

Figure 7:
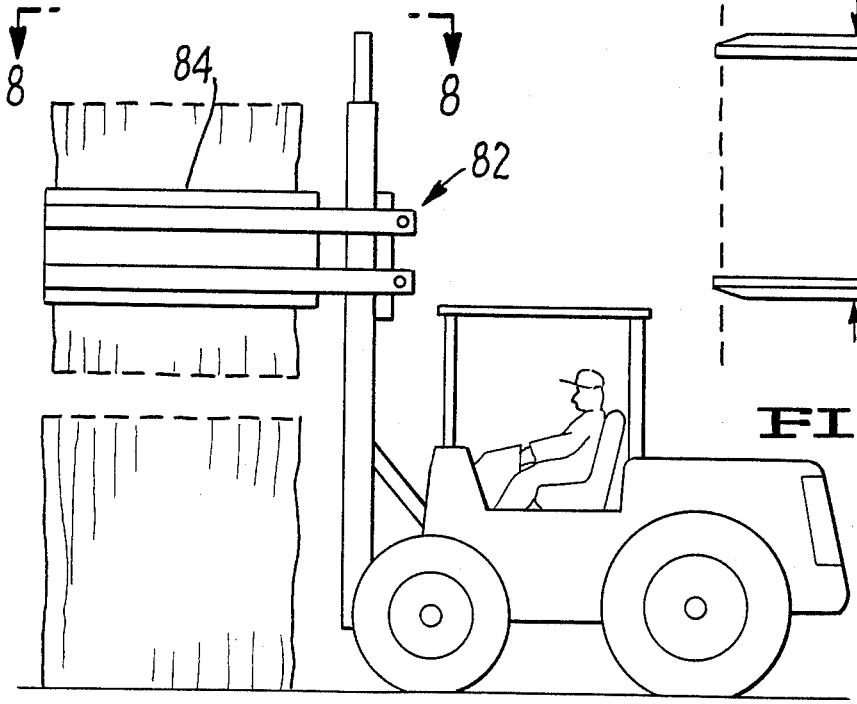
FIG. 7 is a side elevational view of a hay squeeze of the type which may be used to handle bales formed according to the invention.
Figure 8:
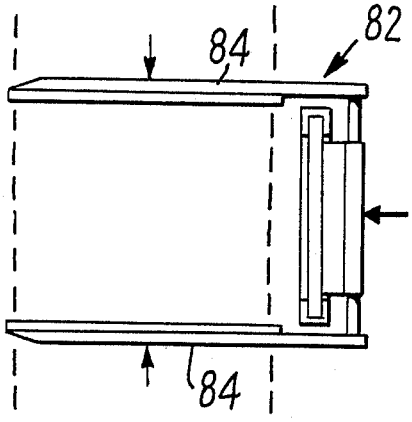
FIG. 8 is a top plan view taken on the plane designated by line 8—8 of FIG. 7.

After a bale is discharged from a trailer, it may be stacked for storage. Such stacking is also shown to the left of FIG. 1. Although the stacks in FIG. 1 are only two bales high, it should be appreciated that stacking may be carried out to any desired height. Stacking is achieved through means of a hay squeeze 82. Such a squeeze is shown to the left of FIG. 1 and is also shown in more detail in FIGS. 7 and 8. It employs a wheel supported chassis with a tower at its front similar to a forklift. Rather than carrying a fork, however, the tower carries a pair of paddles 84 which are movable toward and away from each other to engage and squeeze an item to be lifted. The squeeze is power operated and controlled through means of a human operator, much in the same way as a forklift is operated.

The squeeze may also be used to remove segments of a bale. Such removal is effected by simply forcing the paddles of the squeeze into a bale, then squeezing a segment of the bale between the paddles and then moving the squeeze to remove the segment from the bale. The relatively loose wafer-like construction of the bale facilitates such removal, without the necessity of employing saws or heavy cutting equipment.

It has been found that bales formed by the method and apparatus of the present invention uniformly have the longitudinal elements thereof extending in a generally vertical direction. This results from loading the cuttings into the compaction chamber so that the cuttings extend generally parallel to the direction of plunger travel and folding of the longer cuttings about axes extending generally normal to the direction of plunger travel. In the embodiment illustrated, the inclined ramp-like surface at the lower end of the biased wall 52 also contributes to such orientation.

From the foregoing description and the diagrammatic illustration of FIG. 1, it should also be appreciated that the method of the invention is continuous in the sense that the packer may be continuously operated to load one transfer trailer after another. Thus, a single packer may service a plurality of trailers. It is also anticipated that a plurality of loaders could be used to bring cuttings to the site of the packer.

CONCLUSION

While a preferred embodiment of the invention has been illustrated and described, it should be understood that the invention is not intended to be limited to the specifics of this embodiment, but rather is defined by the accompanying claims.

What is claimed is:

1. A method of processing elongate brush cuttings by compressing the cuttings within a compaction chamber having a plunger movable longitudinally therethrough, said method comprising: loading the cuttings into the compaction chamber in an orientation extending generally parallel to the longitudinal direction of plunger movement; moving the plunger longitudinally through the chamber to compress cuttings and force them into an orientation extending generally normal to the direction of plunger travel; and, discharging the cuttings from the chamber while maintaining said orientation.

2. A method according to claim 1 wherein the step of moving the plunger to compress the cuttings forces the cuttings into a generally vertical orientation.

3. A method according to claim 1 wherein: at least some of the cuttings have a length exceeding the length of the chamber; and, upon being loaded into the chamber, said cuttings are folded about axes extending generally normal to the longitudinal direction of plunger movement.

4. A method according to claim 3 wherein the axes about which the cuttings are folded extend generally horizontally.

5. A method according to claim 3 wherein: the cuttings are loaded into the chamber through means of a grapple disposed for movement above and into the chamber; and, the grapple is lowered into the chamber to fold the cuttings.

6. A method according to claim 1 wherein the cuttings are discharged from the chamber by pushing the cuttings through an opening in one side of the chamber through means of the force imparted to the cuttings by the plunger.

7. A method according to claim 6 wherein the cuttings are discharged through the open side of the compaction chamber into a transfer chamber having a biased wall opposed to the compaction plunger, said biased wall being movable in response to force imparted thereto by the plunger through the cuttings, whereby successive loads of compacted cuttings may be discharged into the transfer chamber so as to form a bale of cuttings therein.

8. A method according to claim 7 wherein, upon formation of a bale of desired size within the transfer chamber, the chamber is transported to a discharge location and the bale is discharged therefrom by moving the biased wall against the bale.

9. A method of processing elongate brush cuttings, said method comprising: collecting said cuttings adjacent a transfer packer having an open topped compaction chamber and a compaction plunger movable through the chamber in a longitudinal direction; loading cuttings into the open top of the chamber in an orientation wherein the cuttings extend generally parallel to the longitudinal direction in which the plunger moves; moving the plunger through the chamber in said longitudinal direction to compress the cuttings within the chamber and force the cuttings into an orientation extending generally normal to the longitudinal direction of plunger movements; and, discharging said cuttings from the chamber while in a condition extending generally normal to the direction of longitudinal plunger travel.

10. A method of forming a bale of elongate brush cuttings, said method comprising: loading successive charges of cuttings into a chamber having compaction plunger moveable therethrough in a longitudinal direction, said charges being so loaded that the cuttings extend in a direction parallel to said direction; successively compressing and discharging each charge of cuttings by moving the plunger longitudinally through the chamber to force the cuttings into a vertical orientation extending generally normal to the direction of plunger movement, and push the charge through an opening in one side of the chamber; and, collecting the successive charges in juxtaposition while maintaining the cuttings therein in vertical orientation.

11. A portable transfer packer for collecting and compressing elongate brush cuttings, said packer comprising: a wheel supported chassis; an open topped hopper supported on the chassis; said hopper extending longitudinally of the chassis and having a discharge opening at one end of the chassis; a compaction ram supported on said chassis to the side of the hopper opposite said discharge opening, said ram carrying a compaction plunger movable longitudinally through the hopper from said opposite side to the discharge opening; a deck supported on the chassis above the compaction ram; a power operated crane supported on the deck for movement about a generally vertical axis, said crane having an articulated lifting arm carrying a grapple at the distal end thereof and being selectively operable to move the grapple from pickup positions to the sides of the packer to a discharge position extending into and disposed within the open top of the hopper to compact and fold elongate cuttings within the hopper; and, a coupling carried by the chassis to secure a transfer trailer in receiving relationship to the discharge opening of the hopper.

12. A method of processing elongate brush cuttings, said method comprising: collecting said cuttings adjacent a transfer packer having an open topped compaction chamber and a compaction plunger movable through the chamber in a longitudinal direction; loading cuttings into the open top of the chamber in an orientation wherein at least some of the cuttings extend generally parallel to the longitudinal direction in which the plunger moves; moving the plunger through the chamber in said longitudinal direction to compress the cuttings within the chamber and force the cuttings into an orientation extending generally normal to the longitudinal direction of plunger movements; and, discharging said cuttings from the chamber while in a condition extending generally normal to the direction of longitudinal plunger travel.

* * * * *